US006286237B1

(12) United States Patent
Toutounchian

(10) Patent No.: US 6,286,237 B1
(45) Date of Patent: Sep. 11, 2001

(54) MULTIPLE FUNCTION IRONING BOARD

(76) Inventor: Rezza Toutounchian, Five Corners House 26 Kerris Way Lower Earley, Reading Berkshire RG6 5VW (GB)

( * ) Notice: Subject to any disclaimer, the term of this patent is extended or adjusted under 35 U.S.C. 154(b) by 0 days.

(21) Appl. No.: 09/426,162

(22) Filed: Oct. 22, 1999

(51) Int. Cl.[7] ..... D06F 81/00
(52) U.S. Cl. ..... 38/107; 38/135
(58) Field of Search ..... 380/104, 106, 380/107, 109, 110, 135, 137, DIG. 1, DIG. 2, DIG. 3

(56) References Cited

U.S. PATENT DOCUMENTS 1,337,936 * 4/1920 Martindale ..... 38/140
2,210,648 * 8/1940 Battelle ..... 38/104
2,955,370 * 10/1960 Tipping ..... 38/135
2,999,325 * 9/1961 Munson et al. ..... 38/140
3,698,110 * 10/1972 Shettel ..... 38/107
4,480,556 * 11/1984 Wilson et al. ..... 38/104
4,525,942 * 7/1985 Azzara ..... 38/107 X
4,910,896 * 3/1990 Ruschitzka ..... 38/107
5,452,531 * 9/1995 Graville et al. ..... 38/104

* cited by examiner

*Primary Examiner*—Ismael Izaguirre

(57) ABSTRACT

A versatile ironing board is provided including a collapsible leg assembly for maintaining the ironing board in an elevated orientation. Also included is at least one supporting member pivotally coupled to a periphery of the ironing board.

18 Claims, 6 Drawing Sheets

FIG. 9
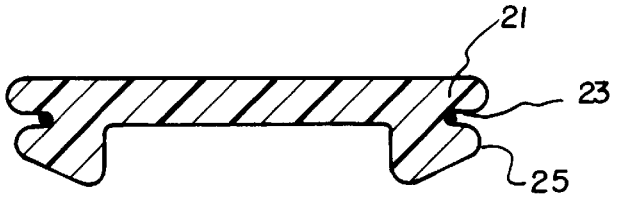
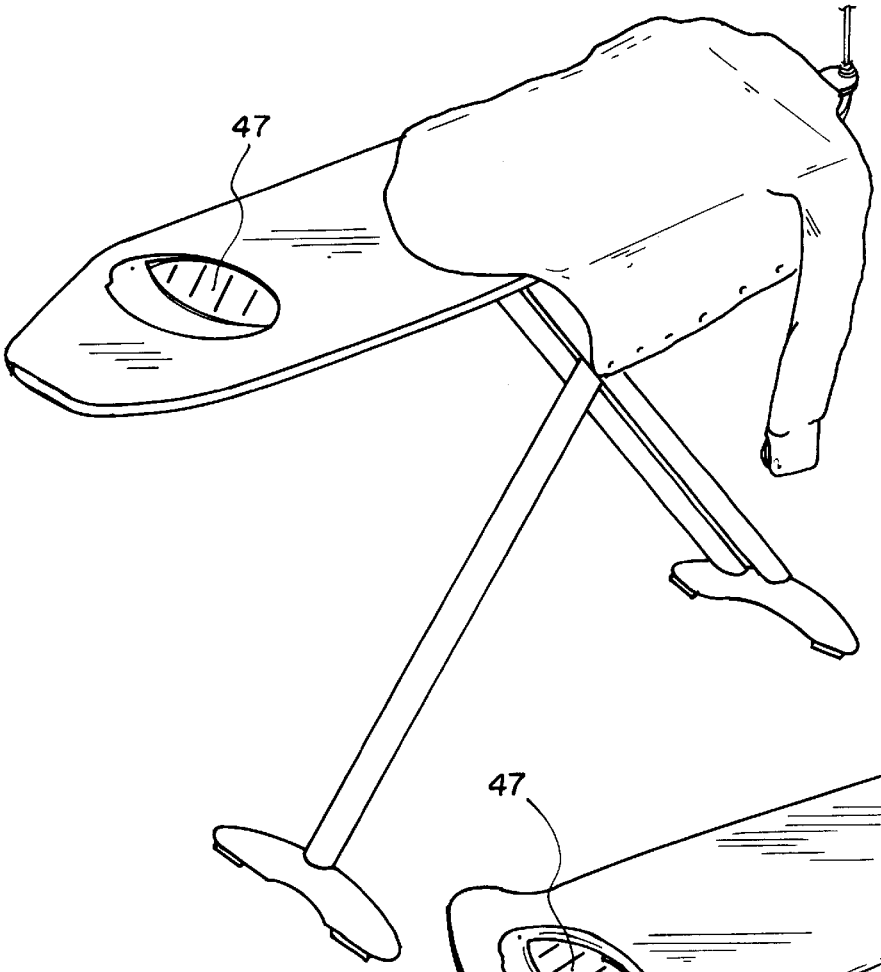
FIG. 10
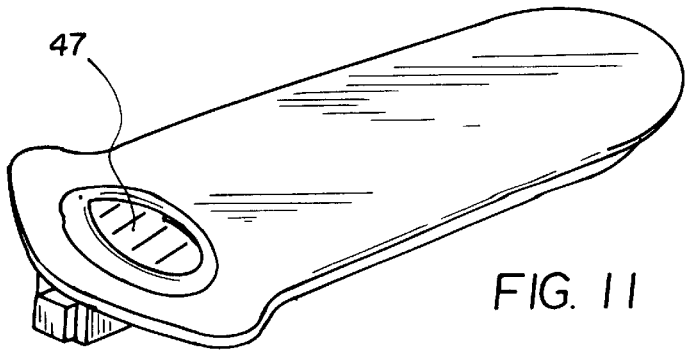
FIG. 11

MULTIPLE FUNCTION IRONING BOARD

BACKGROUND OF THE INVENTION

1. Field of the Invention

The present invention relates to ironing boards and more particularly pertains to a new multiple function ironing board for conveniently ironing various articles of clothing.

2. Description of the Prior Art

The use of ironing boards is known in the prior art. More specifically, ironing boards heretofore devised and utilized are known to consist basically of familiar, expected and obvious structural configurations, notwithstanding the myriad of designs encompassed by the crowded prior art which have been developed for the fulfillment of countless objectives and requirements.

Known prior art ironing boards include U.S. Pat. Nos. 5,016,367; 4,910,896; 448,661; 5,142,802; 3,212,742; and U.S. Pat. No. Des. 263,781.

In these respects, the multiple function ironing board according to the present invention substantially departs from the conventional concepts and designs of the prior art, and in so doing provides an apparatus primarily developed for the purpose of conveniently ironing various articles of clothing.

SUMMARY OF THE INVENTION

In view of the foregoing disadvantages inherent in the known types of ironing boards now present in the prior art, the present invention provides a new multiple function ironing board construction wherein the same can be utilized for conveniently ironing various articles of clothing.

The general purpose of the present invention, which will be described subsequently in greater detail, is to provide a new multiple function ironing board apparatus and method which has many of the advantages of the ironing boards mentioned heretofore and many novel features that result in a new multiple function ironing board which is not anticipated, rendered obvious, suggested, or even implied by any of the prior art ironing boards, either alone or in any combination thereof.

To attain this, the present invention generally comprises a board having a planar top surface and a periphery defined by a pair of elongated generally parallel side edges. As shown in FIG. 2, the periphery has a first generally arcuate end edge with a first radius of curvature. The periphery further has a second generally arcuate end edge with a second radius of curvature greater than the first radius of curvature. Portions of the periphery between the side edges and the second end edge have a converging configuration for reasons that will soon become apparent. Also included is a leg assembly having a first leg with a top end pivotally mounted to a bottom surface of the ironing board adjacent to the first end edge. Associated therewith is a second leg having a top end slidably and pivotally coupled to the bottom surface of the ironing board along a center line thereof. As shown in FIG. 1, the second leg has a central extent pivotally coupled to that of the first leg. It should be noted that each leg has a bottom end with a cross bar mounted thereon for serving as feet. Note FIG. 3. Next provided is a pair of wings each having a planar triangular configuration, as shown in FIG. 2. Each of such wings has an inboard edge flanked by a pair of tight corners situated opposite a broad arcuate corner. Each wing is hingably coupled along the inboard edge thereof to one of the beveled portions of the periphery of the ironing board. In use, each wing serves to pivot between a stored orientation abutting the bottom surface of the ironing board and a deployed orientation extending in coplanar relationship with the ironing board. Note FIGS. 3 & 2, respectively. Finally, an iron rest assembly is provided including a slot formed in the bottom surface of the ironing board along the first end edge thereof. The slot preferably spans between a pair of opposed portions of the side edges of the periphery of the ironing board. A guide is slidably situated within the slot. Further, a disk-shaped plate is provided having a circular peripheral lip coupled to a periphery thereof. Such lip extends both upwardly and downwardly from the plate for defining a recess on an upper face and lower face of the plate. The plate is pivotally coupled to the guide. In operation, the plate is adapted for being pivoted to a first orientation situated on the top surface of the ironing board. The plate is further capable of a second orientation extending from the ironing board in coplanar relationship therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple function ironing board apparatus and method which has many of the advantages of the ironing boards mentioned heretofore and many novel features that result in a new multiple function ironing board which is not anticipated, rendered obvious, suggested, or even implied by any of the prior art ironing boards, either alone or in any combination thereof.

It is another object of the present invention to provide a new multiple function ironing board which may be easily and efficiently manufactured and marketed.

It is a further object of the present invention to provide a new multiple function ironing board which is of a durable and reliable construction.

An even further object of the present invention is to provide a new multiple function ironing board which is susceptible of a low cost of manufacture with regard to both materials and labor, and which accordingly is then susceptible of low prices of sale to the consuming public, thereby making such multiple function ironing board economically available to the buying public.

Still yet another object of the present invention is to provide a new multiple function ironing board which provides in the apparatuses and methods of the prior art some of the advantages thereof, while simultaneously overcoming some of the disadvantages normally associated therewith.

Still another object of the present invention is to provide a new multiple function ironing board for conveniently ironing various articles of clothing.

Even still another object of the present invention is to provide a new multiple function ironing board that includes a collapsible leg assembly for maintaining the ironing board in an elevated orientation. Also included is at least one supporting member pivotally coupled to a periphery of the ironing board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a cross-sectional view of the present invention taken along line 9—9 shown in FIG. 2.

FIG. 10 is a perspective view of another alternative of the present invention.

FIG. 11 is a perspective view of still yet another alternative feature of the present invention.

DESCRIPTION OF THE PREFERRED EMBODIMENT

Figure 1:
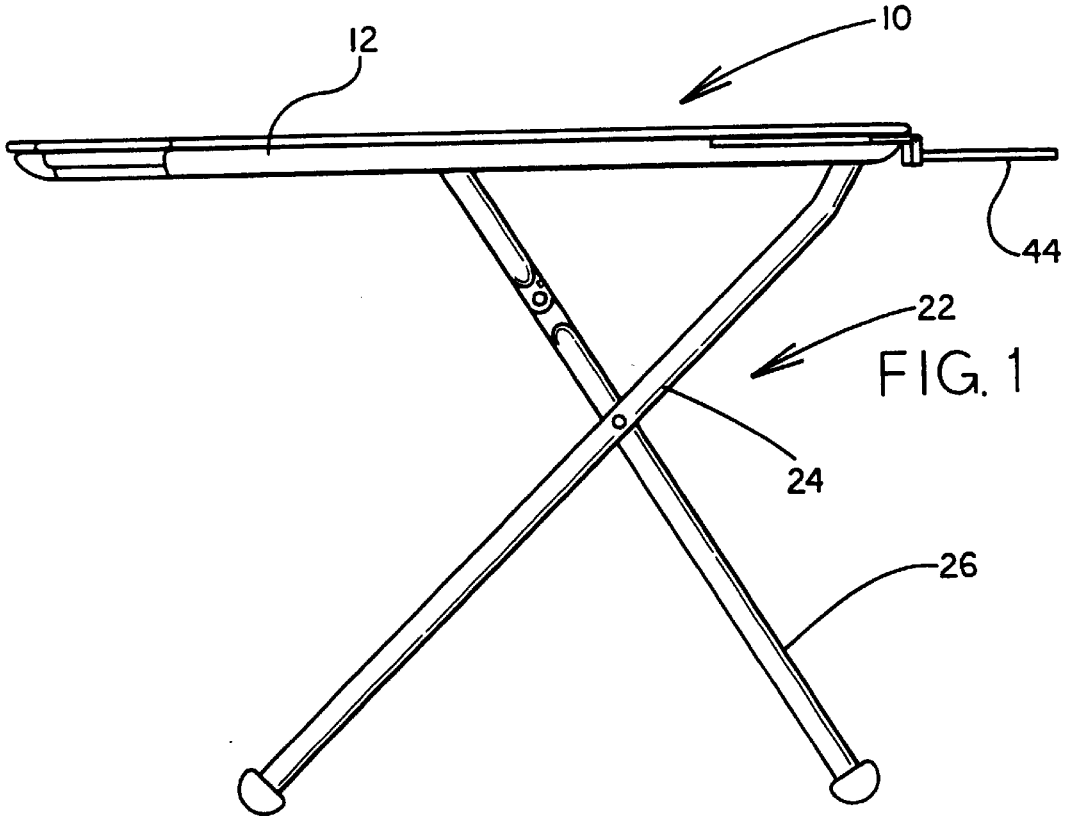
FIG. 1 is a side view of a new multiple function ironing board according to the present invention.

With reference now to the drawings, and in particular to FIGS. 1 through 11 thereof, a new multiple function ironing board embodying the principles and concepts of the present invention and generally designated by the reference numeral 10 will be described.

Figure 2:
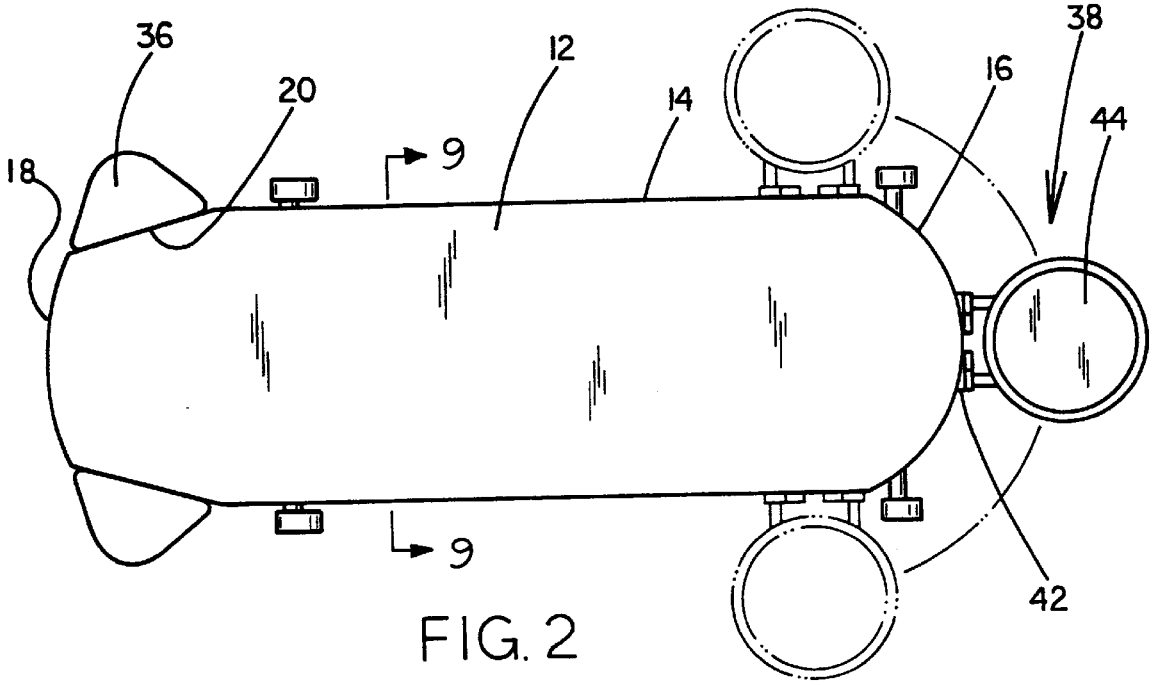
FIG. 2 is a top view of the present invention.

The present invention, designated as numeral 10, includes an ironing board 12 that can be used by either right or left handed people. The ironing board has a planar top surface and a periphery defined by a pair of elongated, generally parallel side edges 14. As an option, the side edges may be formed to converge or diverge at an angle of about +/−5 degrees. As shown in FIG. 2, the periphery has a first generally arcuate end edge 16 with a first radius of curvature. The periphery further has a second generally arcuate end edge 18 with a second radius of curvature greater than the first radius of curvature for assisting in the ironing of shirts. The radius of curvature of the second arcuate end edge adapted for matching the curvature of a yoke of the shirt. Linear beveled portions 20 of the periphery between the side edges and the second end edge have a converging configuration for reasons that will soon become apparent.

Ideally, the periphery of the ironing board 12 includes a peripheral recess 21 formed therein for receiving an elastic band 23 which in turn maintains a cover in place during use. Note FIG. 9. In the preferred embodiment, the cover is constructed from a type of material that affords a predetermined amount of friction with a shirt or other article of clothing being ironed. This friction maintains the shirt or other article of clothing in place during use. It should be noted that a portion of the shirt or other article of clothing preferably extends over a lower extent 25 of the periphery of the ironing board that is not protected by the cover. As such, when the shirt is slightly lifted and slidably moved, no friction abates such movement.

Figure 3:
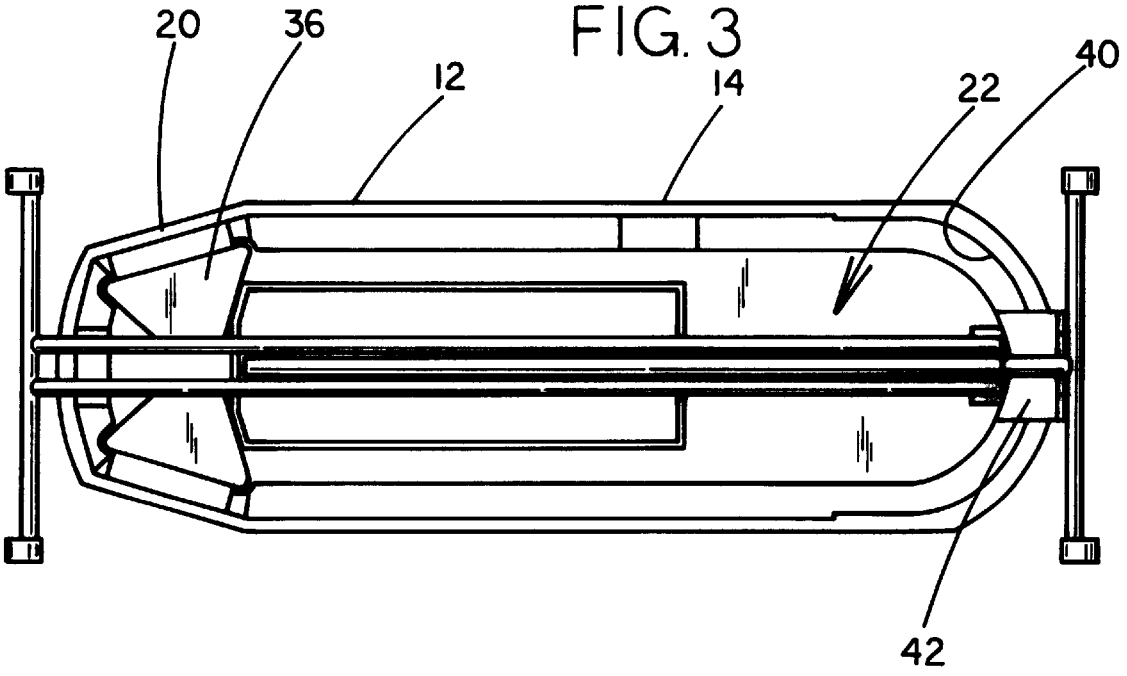
FIG. 3 is a bottom view of the present invention.
Figure 4:
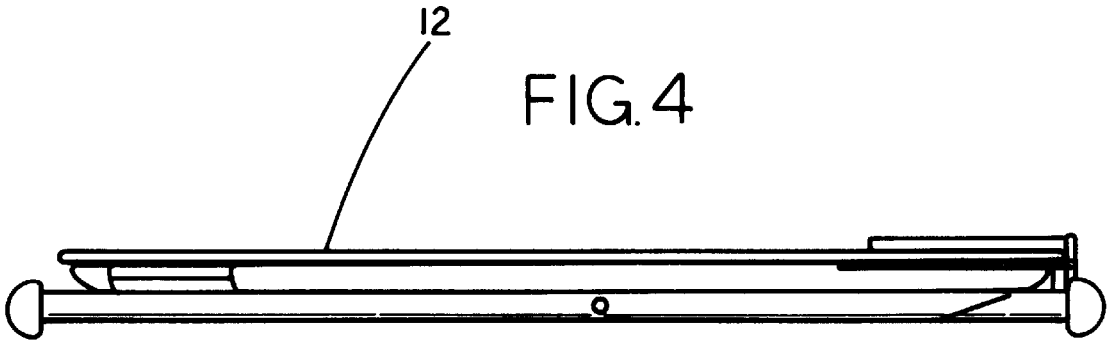
FIG. 4 is a side view of the present invention with the leg assembly collapsed.
Figure 5:
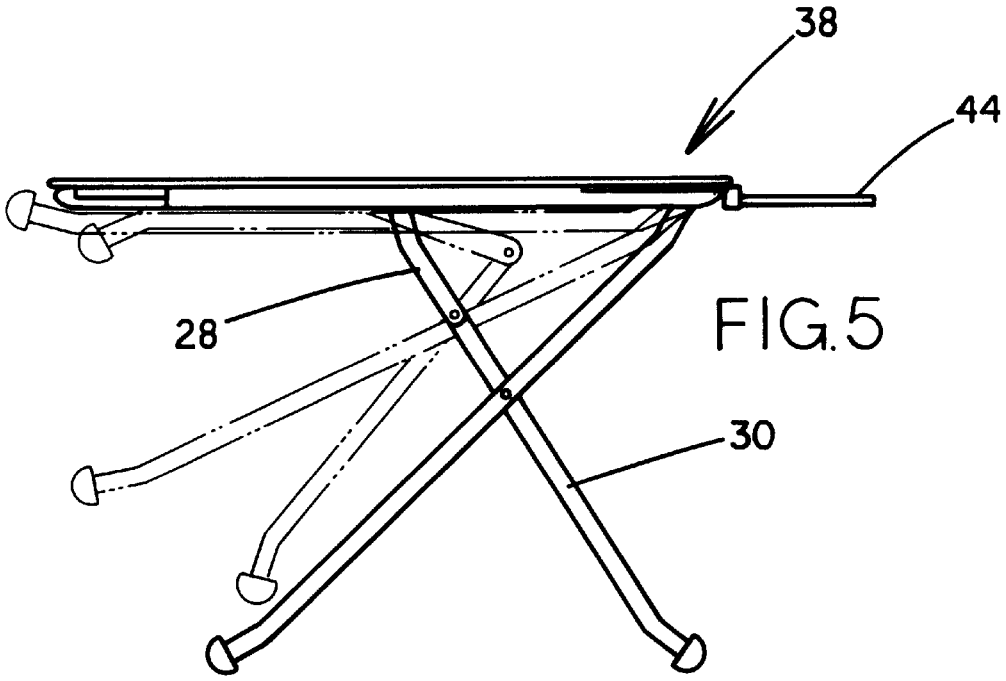
FIG. 5 is a side view of an alternate embodiment of the leg assembly of the present invention.
Figure 6:
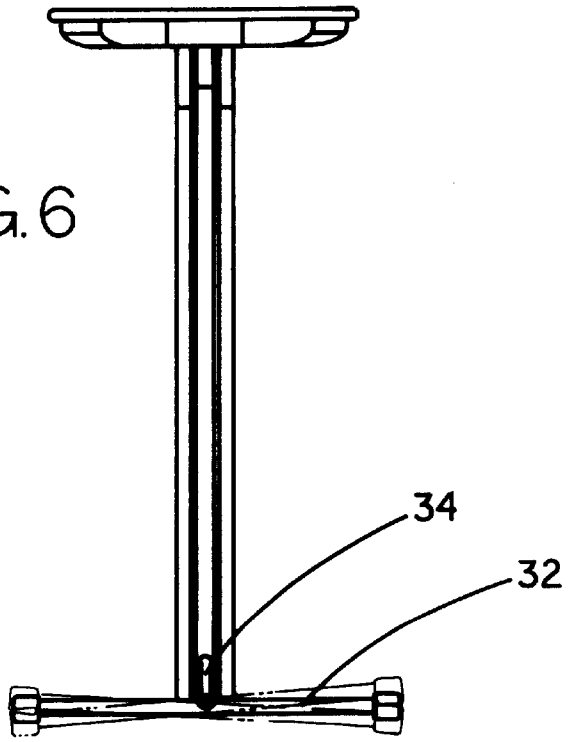
FIG. 6 is a front view of an optional feature of the leg assembly of the present invention.
Figure 7:
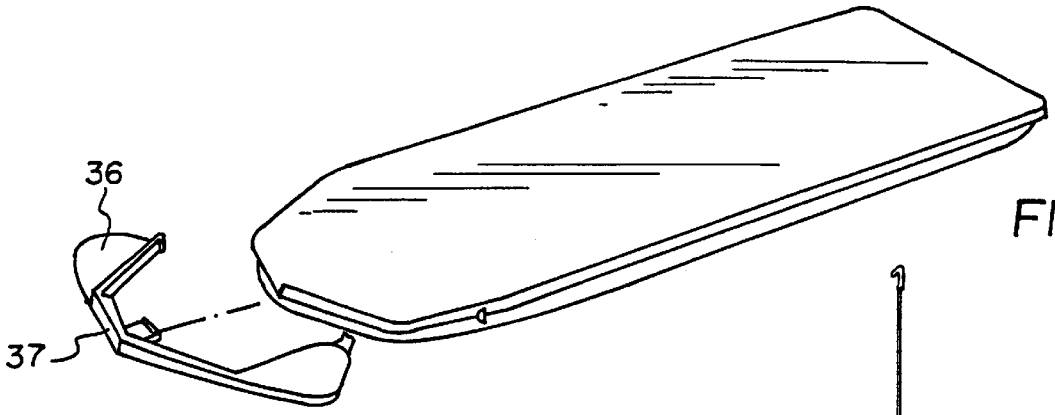
FIG. 7 is a perspective view of an alternate embodiment of the present invention including detachable wings.
Figure 8:
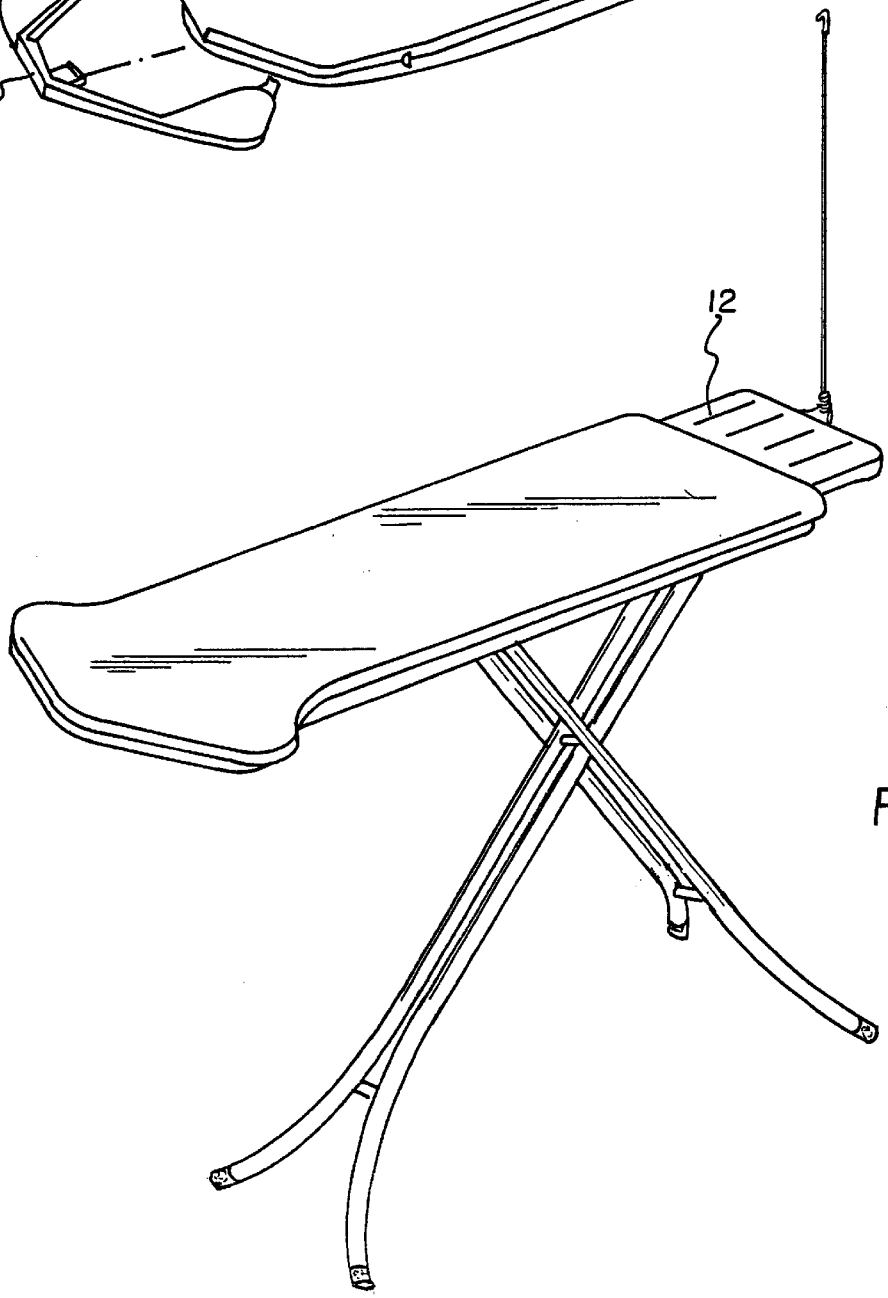
FIG. 8 is a perspective view of an alternate embodiment of the present invention including integral wings.

Also included is a leg assembly 22 having a first leg 24 with a top end pivotally mounted to a bottom surface of the ironing board adjacent to the first end edge. Associated therewith is a second leg 26 having a top end slidably and pivotally coupled to the bottom surface of the ironing board along a center line thereof. As shown in FIG. 1, the second leg has a central extent pivotally coupled to that of the first leg. As shown in FIGS. 3 & 8, the legs may each comprise of either a single or double bar. It should be noted that each leg has a bottom end with a cross bar mounted thereon for serving as feet. Note FIG. 3. Further, upper ends of the legs are preferably upturned, as shown in FIG. 1.

As an option, the second leg may be defined by a short inboard extent 28 and an elongated outboard extent 30. Note FIG. 5. As shown in such Figure, this allows the collapsing of the second leg more compactly. Yet another option entails at least one leg of the leg assembly having a stabilizing cross bar 32 pivotally mounted thereon about a longitudinal axis. Note FIG. 5. Such stabilizing cross bar further has a lock 34 for fixing an angle that the stabilizing cross bar forms with the associated leg.

Next provided is a pair of wings 36 each having a planar triangular configuration, as shown in FIG. 2. Each of such wings has an inboard edge flanked by a pair of tight corners situated opposite a broad arcuate corner. Each wing is hingably coupled along the inboard edge thereof to one of the beveled portions of the periphery of the ironing board. In use, each wing serves to pivot between a stored orientation abutting the bottom surface of the ironing board and a deployed orientation extending in coplanar relationship with the ironing board. Note FIGS. 2 & 3, respectively. When extended, the wings function to assist in the ironing of shirts by taking the shape of shoulders of the shirts.

Figure 12:
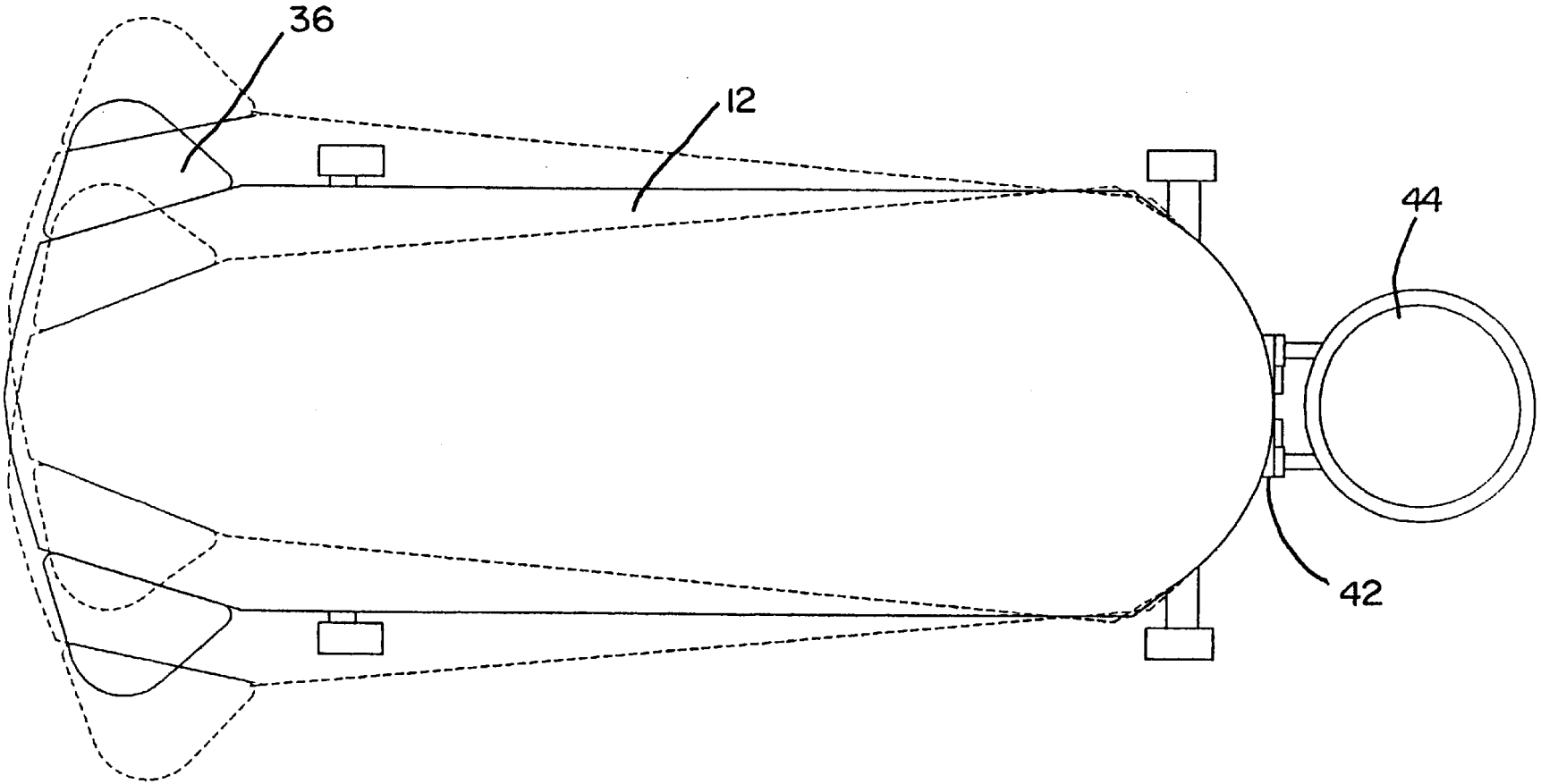
FIG. 12 is a top plan view of the present invention showing the alternate positions of the ironing board.

In the alternative, the wings may be fixedly coupled to the ironing board, as shown in FIG. 8. In another embodiment, the wings may be integrally coupled via a mount 37 which is in turn snappily coupled to the ironing board. Note FIG. 7. As shown in FIG. 12, the ironing board may also be rotatably coupled to the first leg such that the ironing board may be rotated +/−5 degrees to either side to accommodate the legs of a left or right handed user.

Finally, an iron rest assembly 38 is provided including a slot 40 formed in the bottom surface of the ironing board along the first end edge thereof. The slot preferably spans between a pair of opposed portions of the side edges of the periphery of the ironing board. A guide 42 is slidably situated within the slot. A dove tail or T-shaped coupling may be employed to maintain the guide and slot in working relationship. Further, a disk-shaped plate 44 is provided having a circular peripheral lip coupled to a periphery thereof. Such lip extends both upwardly and downwardly from the plate for defining a recess on an upper face and lower face of the plate.

The plate of the iron rest assembly is pivotally coupled to the guide. In operation, the plate is adapted for being pivoted to a first orientation situated on the top surface of the ironing board. The plate is further capable of a second orientation extending from the ironing board in coplanar relationship therewith. In both the first and second orientation, the plate and guide of the iron rest assembly are adapted to be slid within the slot 40. As such, the present invention may be used in compact locations and further the iron rest assembly and iron may be positioned either close or distant a user. It should be noted that both the plate of the iron rest and the wings may each be equipped with spring biased pins and associated bores for locking them in the desired orientation.

As an option, the iron rest assembly and iron may each be equipped with a magnet for holding the same in place. Such magnets may be covered with a non-metallic material such as paper or plastic if desired. In an alternate embodiment, the plate of the iron rest assembly has an angled recess 47 which is configured as shown in FIGS. 10 & 11. Such plate of the alternate embodiment may be fixedly mounted to either a front or rear portion of the ironing board per the desires of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A versatile ironing board comprising:

an ironing board;

a collapsible leg assembly for selectively maintaining the ironing board in an elevated orientation;

at least one member coupled to a periphery of the ironing board, wherein the member includes a wing having a generally triangular configuration; and wherein the ironing board is rotatably coupled to the leg assembly such that the ironing board may be rotated from side to side in a horizontal plane.

2. A versatile ironing board as set forth in claim 1 wherein the member is pivotable between a first orientation abutting a bottom surface of the ironing board and a second orientation extending in coplanar relationship with the ironing board.

3. A versatile ironing board as set forth in claim 1 wherein the member includes an iron rest.

4. A versatile ironing board as set forth in claim 1 wherein the member is slidable along the periphery of the ironing board.

5. A versatile ironing board as set forth in claim 1 wherein the member is pivotable between a first orientation abutting a top surface of the ironing board and a second orientation extending in coplanar relationship with the ironing board.

6. A versatile ironing board as set forth in claim 1 wherein at least one leg of the leg assembly has a stabilizer pivotally mounted thereon.

7. A versatile ironing board as set forth in claim 1 wherein one leg of the leg assembly is defined by a pair of hinged portions.

8. A versatile ironing board as set forth in claim 1 wherein a periphery of the ironing board has a peripheral recess with an elastic band mounted thereon for holding a cover on the ironing board.

9. A versatile ironing board as set forth in claim 1 wherein the member is snappily mounted to the ironing board.

10. An ironing board comprising, in combination:

a board including a planar top surface and a bottom, the board having a periphery defined by a pair of elongated generally parallel side edges, a first generally arcuate end edge with a first radius of curvature and a second end edge, a leg assembly for selectively maintaining the board in an elevated condition above a ground surface;

an iron rest assembly including a slot formed in the bottom of the board adjacent to the first end edge thereof between a pair of opposed portions of the side edges of the periphery of the board, a guide slidably situated in the slot, and an iron support mounted on the guide such that sliding the guide in the slot moves the iron support along the first end edge for selectively positioning the iron support at locations adjacent to the first end edge, the iron support being pivotally coupled to the guide for permitting pivoting of the iron support between a first orientation situated adjacent to the top surface of the board and a second orientation extending from the board for resting an iron on the iron support.

11. The board of claim 10, additionally comprising a circular peripheral lip coupled to a periphery thereof and extending upwardly and downwardly therefrom for defining a recess on an upper face and lower face of the plate.

12. The board of claim 10, wherein the second side edge has a generally arcuate shape.

13. The board of claim 10, wherein a second radius of curvature of the second end edge is greater than the first radius of curvature of the first end edge.

14. A versatile ironing board comprising:

an ironing board;

a collapsible leg assembly for selectively maintaining the ironing board in an elevated orientation;

at least one member coupled to a periphery of the ironing board, wherein the member is pivotable between a first orientation abutting a bottom surface of the ironing board and a second orientation extending in coplanar relationship with the ironing board; and wherein the ironing board is rotatably coupled to the leg assembly such that the ironing board may be rotated from side to side in a horizontal plane.

15. A versatile ironing board as set forth in claim 14, wherein the member is slidable along the periphery of the ironing board.

16. A versatile ironing board as set forth in claim 14, wherein the member is pivotable between a first orientation abutting a top surface of the ironing board and a second orientation extending in coplanar relationship with the ironing board.

17. A versatile ironing board as set forth in claim 14, wherein at least one leg of the leg assembly has a stabilizer pivotally mounted thereon.

18. A versatile ironing board as set forth in claim 14, wherein a periphery of the ironing board has a peripheral recess with an elastic band mounted thereon for holding a cover on the ironing board.

* * * * *